US009527694B2

(12) United States Patent
Barea

(10) Patent No.: US 9,527,694 B2
(45) **Date of Patent: *Dec. 27, 2016**

(54) SYSTEM AND METHOD FOR FEEDING METAL WIRES AT CONSTANT TENSION

(71) Applicant: BTSR INTERNATIONAL S.P.A., Olgiate Olona (Varese) (IT)

(72) Inventor: Tiziano Barea, Busto Arsizio (IT)

(73) Assignee: BTSR INTERNATIONAL S.P.A., Oligiate Olona (Varese) (IT)

( * ) Notice: Subject to any disclaimer, the term of this patent is extended or adjusted under 35 U.S.C. 154(b) by 339 days.

This patent is subject to a terminal disclaimer.

(21) Appl. No.: 14/354,279

(22) PCT Filed: Dec. 21, 2012

(86) PCT No.: PCT/IB2012/002795

§ 371 (c)(1),
(2) Date: Apr. 25, 2014

(87) PCT Pub. No.: WO2013/098631

PCT Pub. Date: Jul. 4, 2013

(65) Prior Publication Data

US 2014/0326819 A1 Nov. 6, 2014

(30) Foreign Application Priority Data

Dec. 28, 2011 (IT) ..... MI2011A2414

(51) Int. Cl.
*B65H 59/38* (2006.01)
*H01F 41/06* (2016.01)
*B65H 59/16* (2006.01)

(52) U.S. Cl.
CPC ..... *B65H 59/388* (2013.01); *B65H 59/16* (2013.01); *H01F 41/094* (2016.01); *B65H 2701/36* (2013.01)

(58) Field of Classification Search
CPC ... B65H 59/38; B65H 59/388; B65H 2701/36; H01F 41/094
See application file for complete search history.

(56) References Cited

U.S. PATENT DOCUMENTS 3,637,149 A 1/1972 Frei
3,796,385 A 3/1974 Jacobsson
(Continued)

FOREIGN PATENT DOCUMENTS

DE 4104087 A1 8/1991
DE 4313255 A1 10/1994
(Continued)

OTHER PUBLICATIONS

Japanese Office Action dated May 13, 2015 in corresponding Japanese patent application No. 2014-543992.
(Continued)

*Primary Examiner* — William E Dondero
(74) *Attorney, Agent, or Firm* — Vorys, Sater, Seymour and Pease LLP

(57) ABSTRACT

A system for supplying metal wire to a machine by a wire supply device. The wire having a desired tension detected by a tension sensor. The supply device has at least one rotary member driven by an actuator thereof on which the metal wire is wound for a fraction of rotation or several rotations and adapted to supply the wire to the machine with predefined tension under the action of a control unit. The system has a detector, for detecting at least one wire physical characteristic, downstream of the supply device and connected to the control unit to provide to the latter the data regarding each detected physical characteristic. The control unit intervening on the rotary member for adjusting the wire tension for maintaining, at least approximately around a reference value, the characteristic of the wire controlled. The latter is at least one dimensional and/or electrical characteristic.

19 Claims, 2 Drawing Sheets

(56) References Cited

U.S. PATENT DOCUMENTS

Figure 1:
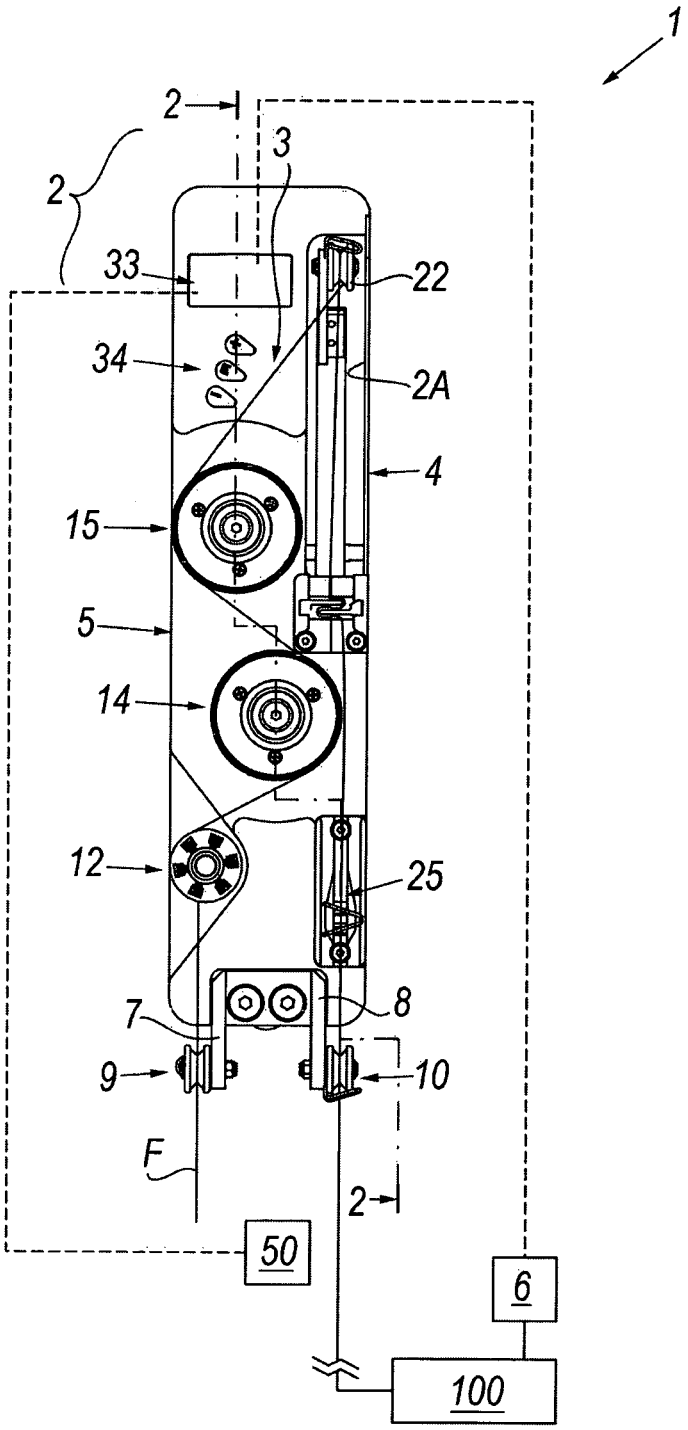

| | | | | |
|---|---|---|---|---|
| 3,843,069 | A | 10/1974 | Deniega et al. | |
| 3,883,083 | A | 5/1975 | Rosen | |
| 4,180,215 | A | 12/1979 | Nurk | |
| 4,852,617 | A | 8/1989 | Hamer et al. | |
| 5,240,194 | A | 8/1993 | Noirot et al. | |
| 5,421,534 | A | 6/1995 | Arnold et al. | |
| 2004/0181935 | A1 | 9/2004 | Rohrbach et al. | |
| 2008/0210804 | A1 | 9/2008 | Barea | |
| 2008/0296425 | A1 | 12/2008 | Comotto et al. | |
| 2009/0178757 | A1 | 7/2009 | Cocovi et al. | |
| 2012/0037601 | A1 | 2/2012 | Watanabe et al. | |
| 2015/0314982 | A1* | 11/2015 | Barea | B65H 59/388 242/419.1 |

FOREIGN PATENT DOCUMENTS

| | | | |
|---|---|---|---|
| DE | 102004020465 | B3 | 9/2005 |
| EP | 0424770 | A2 | 5/1991 |
| EP | 0652312 | A1 | 5/1995 |
| EP | 2014809 | A1 | 1/2009 |
| EP | 2031610 | A1 | 3/2009 |
| FR | 2655888 | A1 | 6/1991 |
| JP | 2002542575 | A | 12/2002 |
| JP | 2007331915 | A | 12/2007 |
| WO | 2006133662 | A1 | 12/2006 |
| WO | 2007006411 | A1 | 1/2007 |
| WO | 2007048528 | A1 | 5/2007 |
| WO | 2007096765 | A1 | 8/2007 |
| WO | 2010116412 | A1 | 10/2010 |
| WO | 2013/064879 | A1 | 5/2013 |
| WO | 2013/072736 | A1 | 5/2013 |
| WO | 2013/088233 | A1 | 6/2013 |
| WO | 2013/093592 | A1 | 6/2013 |

OTHER PUBLICATIONS

U.S. Appl. No. 14/353,728 to Tiziano Barea, "Positive Feeder Device for Feeding Metal Wires at Constant Tension," filed Apr. 23, 2014. (US National Stage of WO 2013/064879 A1).

U.S. Appl. No. 14/353,806 to Tiziano Barea, "Yarn Feeder of Storage Type With Magnetic Brake," filed Apr. 24, 2014. (US National Stage of WO 2013/072736 A1).

U.S. Appl. No. 14/353,867 to Tiziano Barea, "Device for Feeding Yarn to a Textile Machine," filed Apr. 24, 2014. (US National Stage of WO 2013/088233 A1).

U.S. Appl. No. 14/354,211 to Tiziano Barea, "Method and Device for Storing Yarn in Order to Feed Thread Without Creating Twisting Thereof," filed Apr. 25, 2014. (US National Stage of WO 2013/093592 A1).

International Search Report mailed Apr. 4, 2013 for PCT/IB2012/002795 to BTSR International S.P.A. filed Dec. 21, 2012.

* cited by examiner

SYSTEM AND METHOD FOR FEEDING METAL WIRES AT CONSTANT TENSION

CROSS-REFERENCE TO RELATED APPLICATIONS

This is a §371 National Stage Application of International Application No. PCT/IB2012/002795 filed on 21 Dec. 2012, claiming the priority of Italian Patent Application No. MI2011A002414 filed on 28 Dec. 2011.

A system and a method for supplying a metal wire to a machine form an object of the present invention.

US 2009/178757 to Cocovi et al discloses a fabrication method for a tire comprising a circumferential reinforcement, the said method comprising a stage during which a thread is wound around a form, the tension of the thread being managed during winding, in which method the thread tension is managed through the length of a compensation loop acted upon by a spring.

There are known numerous industrial processes (manufacturing of electric motors, coils, etc) in which it is required to wind a metal wire on a physical medium which may be of different shapes, be made of different materials and be part of the finished product or only be used during the production step (like in the case of cores referred to as "air-spaced cores" made using temperature self-cemented wire).

In the aforementioned processes it is important to control the tension to guarantee the constancy and the quality of the finished product. For example, a correct control of the tension guarantees the making of high quality square-shaped coils, thus allowing the wire, also in proximity of the angle present on the medium, to precisely adhere to the medium itself thus preventing what is usually referred to in the field as "loose spring".

In addition, the tension applied to the wire may, for example, cause an extension of the wire and thus a reduction of the section thereof. Thus, given that the section and the length of the wire present in the finished product is varied, there changes the total resistance of the product itself, the resistance R of a wire actually being directly proportional to the length thereof and inversely proportional to the section thereof, like specified in the second Ohm's law $$R=\rho \cdot l/S$$

where:

- l is the length of the wire, measured in meters,
- S is the area of the section, measured in $mm^2$,
- ρ is the electrical resistivity (also referred to as specific electrical resistance or resistivity) of the material, measured in ohms*meter.

The control of the tension is extremely important during the initial step of producing a coil, a step in which the wire is wound on terminals to which it will then be welded (wrapping step) for so as to make it perfectly adhere to the latter and prevent it from breaking. Furthermore, during a winding process carried out on an automatic machine, the subsequent winding of two different coils provides for a step of unloading a completed coil, i.e. the medium on which the wire was wound, and a step of loading the new medium for starting the winding and the predisposition of a new coil. Such operation may occur manually (through the operator) or automatically and in such case it generally provides for the cutting of the wire and the mechanical movement of an arm on which there is fixed the medium on which the wire is already wound (step hereinafter referred to as loading step). During the latter step it is important to control the tension of the wire so that there does not occur any loosening that could for example lead to problems when restarting the subsequent production step.

The normal interval for applying the tensions varies from 5 to 4000 cN, as a function of the diameter of the wire; obviously the smaller the diameter of the wire the lower the operating tension and the greater the importance of controlling the tension during the winding step.

There are known types of supply devices (or simply suppliers) specifically for the metal wires and which allow said control.

A first type of such devices comprises entirely mechanical suppliers which however reveal various drawbacks.

Such device for adjusting the tension should be adjusted manually and controlled position by position and during the entire process. It is an "open loop system" which is not capable of correcting possible errors that arise during the process (variation of the input tension of the metal wire coming from the coil, damage or de-calibration of one of the springs, accumulation of dirt within the input wire braker, etc. . . . ).

In addition, in a supply device of the aforementioned type there is provided for the setting of a single working tension and thus there is no possibility of setting different tensions for the wrapping step, for the working step and for the loading step.

Such set tension also depends on the winding speed, given that it is partly due to a friction tension which is in turn as a function of the aforementioned speed, thus there are observed considerable tension variations during the steps of accelerating and decelerating the machine.

Such tension variations will negatively impact the quality of the end product also causing a variation of the resistive and impedance value of the wound wire.

Lastly, an entirely mechanical supply device does not allow, as a single device, meeting the entire range of tensions with which the general metal wires are supplied to a machine. Thus, this allows having several supply devices or mechanically modifying a part thereof so as to be able to process any type of wire.

There are also known devices or electromechanical suppliers which contrary to the purely mechanical ones have an electric motor to which there is constrained a rotary pulley on which the wire coming from the coil, after passing through a felt wire braker, is wound for at least one rotation before meeting a mobile mechanical arm subject to counter springs. An electronic control unit, besides controlling the actuation of the motor, is capable of measuring the position of such arm and, as a function of said position, it increases or reduces the speed of the motor and thus the speed of supplying the wire (in practice using the arm itself like acceleration and braking command).

Also these suppliers reveal the limits of the strictly mechanical devices mentioned previously given that they provide for the use of the moveable arm to tension the wire and operate as an "open loop" without an actual control of the final product.

Lastly, there are known electronic braking devices which provide for, besides the recovery moveable arm, also a loading cell (or any other equivalent tension detector) arranged exiting from the supply device, a unit for controlling the device using the detected tension value for adjusting a pre-braking device generally upstream of the compensator arm. A solution is for example described in EP 0424770.

Though resolving some problems of the aforementioned devices, such solution however reveals various limits: for example, though operating in a closed-loop manner, the aforementioned device is however not capable of supplying the wire at a tension lower than that of unwinding the coil in that such member may only block the wire and thus increase such tension.

The Italian patent application MI2011A001983, reveals a device capable of supplying a metal wire measuring the tension thereof and uniforming it (reducing or increasing it) to a preset value, possibly programmable, by controlling the closed loop supply. Thus, the device is not only capable of braking the wire, but also supplying it at a tension lower (and not only greater) than that of unwinding the wire from a corresponding source coil.

Such known device allows setting the same supply tension of the wire during the entire process to which it is subjected or differentiated to have different tensions in different operating steps of the machine (wrapping, working, loading); this in an entirely automatic manner or by interfacing with the machine.

Though operating optimally, such device or supply device controls and adjusts the tension of a general metal wire supplied before the wire leaves the device itself. However, it may occur that the tension of the metal wire varies after leaving the supply device during the travel thereof to the machine, in particular for example due to some mechanical passages generally referred to as wire guides, which have the purpose of guiding said wire of the supply device to the point where the machine actually processes it. Actually when there is a difference between the tension of the wire exiting from the supply device and the tension of said wire in proximity of the operating point due to the frictions present during the travel. Said difference may thus cause physical variations in the supplied wire (section and length) and thus varies the value of resistance of the finished product.

In such conditions, the known aforementioned supply device cannot autonomously intervene to prevent the aforementioned drawbacks; the device is thus not capable of automatically compensating what occurs downstream with respect thereto precisely due to the fact that it is outside the control loop thereof. In addition, the possible physical modification of the wire is a condition that does not occur regularly and thus it is not predictable (but variable over time): for example, considering the friction caused by a mechanical passage (wire guide) which may vary incidence thereof for example as a function of the amount of lubricant present on the wire or deposited by the wire during the sliding thereof.

Likewise a variation of the unwinding tension of the wire upstream of the supply device may cause a variation of the physical characteristics of the wire (section, length, resistance), thus causing a variation of the resistive value of the final product; this though supplying said wire with constant tension, the aforementioned phenomenon being outside the tension control loop operated by the supply device.

The same drawback could be caused by the productive tolerance of the wire itself used in the production process.

An object of the present invention is that of providing a method and a system capable of allowing having an ideal control of the tension of the wire supplied to the machine which processes it, regardless of the characteristic of the supplied metal wires, also in case of a capillary wire.

In particular, an object of the invention is that of offering a system of the aforementioned type which allows maintaining the tension of the wire constant up to the machine which processes it so as to prevent physical modifications which could negatively impact on the final use thereof.

A further object of the invention is that of providing a single system which is capable of operating with the entire range of metal wires and operating tensions to which they are subjected.

These and other objects which will be clear to a man skilled in the art are attained by a system and a method for supplying a metal wire to a machine according to the attached claims.

Figure 2:
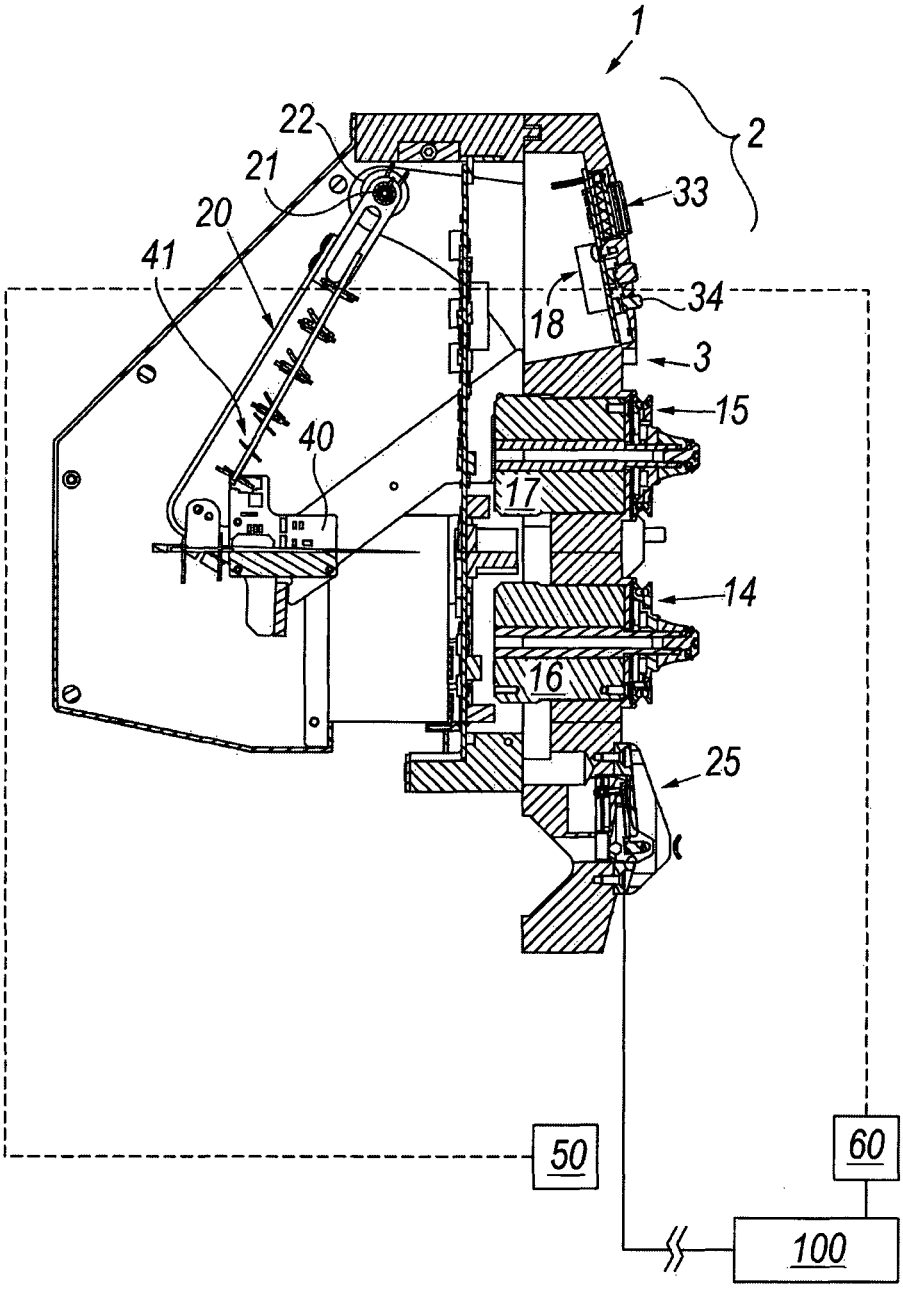

For a better understanding of the present invention there are attached, purely by way of non-limiting example, the following drawings, wherein:

FIG. 1 shows a schematic front view of a system for supplying a metal wire according to the invention; and FIG. 2 shows a view, with section according to line 2-2 of FIG. 1, of the system of FIG. 1.

With reference to the aforementioned figures, a device for supplying metal wires which, by way of example, is that described in MI2011A001983, is represented therein. Obviously, the supply device may thus be of any other known type as long as it is provided with means for controlling and actively adjusting the tension of a wire i.e. electromechanical or electronic devices like described previously in the introduction part of this text. The supply device in the figures is generally indicated with 1 and it comprises a body or casing 2 having a front face 3 and lateral faces 4 and 5. The latter are closed by elements for covering one of which (that of the face 4) is not shown in FIG. 2 with the aim of having visual access to the internal of the body 2.

On the front face 3 or associated thereto and projecting therefrom there are present (starting from the lower part of the body 2 with reference to FIG. 1) media 7 and 8, parallel, carrying a corresponding grooved roller 9 or 10 freely rotating on a pin fixed to the respective medium. Each roller 9, 10, preferably made of ceramic material, has the object of defining the trajectory of a wire F from a coil (not shown) to the device 1 and therefrom to a machine 100. The fact that the rollers are made of ceramic material (or made of equivalent material with low coefficient of friction) has the object of minimizing the friction between the wire and the roller, reducing the possibility of damaging the wire in the contact to the minimum.

The body 2 comprises a wire braker 12 with which the wire F cooperates at the exit of the roller 9 and which has the task of stabilizing the wire entering into the device and cleaning it using the usual felts (not shown) for removing possible paraffin residues (coming from the previous operative drawing step). Such wire, exiting from the wire braker 12, meets a first pulley 14 on which it is wound (for a fraction of rotation or for several rotations) before passing on a second pulley 15, both said pulleys being moved by an electric motor 16 and 17 thereof (respectively) associated with the body 2 and controlled and commanded in the actuation thereof by a control unit 18 also associated to such body.

To the latter there is constrained a moveable recovery arm or compensator 20 having, at a free end 21, a passage for the wire F, preferably through a roller 22 (also made of ceramic material or the like), on which such wire F reaches exiting from the pulley 15 (and passing through a window 2A of the body 2). Such moveable arm is located inside the body 2, behind the face 3 of the latter.

From the roller 22 (or passage member, fixed, equivalent), the wire passes through the window 2 and thus on a tension sensor 25, for example a loading cell, also connected to the control unit 18 from which it exits to pass on the roller 10 and be supplied to the machine.

The control unit 18 is capable of measuring the tension of the wire through the sensor 25 and modifying the rotation speed of the pulleys 14 and 15, operating on respective motors 16 and 17, and thus controlling and uniforming the tension of the wire itself to a possibly programmable preset value (for example as a function of the various operating steps to which the wire F in the machine 100 is subjected), setting in the unit 18, which may be a microprocessor and have (or cooperate with) a memory in which there are tabled one or more tension data, for example corresponding various operating steps mentioned above.

Such preset tension value may be greater or lower than the tension for unwinding the wire from the coil.

The body 2 also carries a display 33 controlled by the unit 18 through which there are displayed the operating conditions of the device (measured tension, preset tension, supply speed, etc. . . . ). On such display device there are also shown the operating parameters, which may be set using the keyboard 34.

The body 2 also provides for (not shown in the figures) connectors which allow electrically supplying the supply device, communicating with the device through a standard or proprietary field bus (RS485, CANBUS, ETHERNET . . . ) to read the state thereof (measured tension, speed, possible alarm conditions) or program the operation thereof (operating tension, operating mode, . . . ). Such body also provides for a 0-10 Vdc input for programming the operating tension in analogue mode and a start-stop input for indicating to the device whether the machine is in operating mode, as well as one or more digital inputs through which the different operating programs are programmed as a function of the different operating steps of the machine (wrapping, working, loading, . . . ).

To the supply device 1 and in particular to the unit 18 there are connected at least one member 50 capable of measuring the diameter of the wire F and/or a member 60 capable of measuring the impedance value (or resistance) of a finished product comprising the wire F (for example an electrical coil).

More in particular, the member 50, interfaced directly or indirectly with the unit 18, is placed at any point between the device 1 and the machine 100. This is the case of a member for measuring the diameter of the wire F such as an electronic gauge, for example optical or laser, an electronic clearing device or similar member.

Regarding the member 60 it is a resistance or impedance detector, for example an ohm detector of the coil obtained through the wire F. Also such member 60, like the 50 one, is directly or indirectly interfaced with the unit 18. Such connection may occur through any communication channel between the unit and said member (50 or 60), such as for example a fieldbus (RS485, CANBUS, MODBUS, PROFIBUS, . . . ) or specific inputs provided for in the two elements (Analogue Input 0-10V, Input 4-20 mA, Digital Inputs, . . . ).

During the supply to a machine, it is known that a metal wire, if subjected to extremely high tensions, is "stretched" and thus such tension varies the diameter thereof. Upon the variation of the latter there also varies the characteristics (in particular electrical, like the electrical resistivity) of the wire itself.

With the aim of avoiding this drawback related to a tension excessively imparted to the wire F, thus the invention provides the detection of the diameter of the wire downstream of the supply device 1 so that, through the this control, it may suitably adjust the tension imparted to the wire by the supply device 1 with the aim of avoiding an unacceptable variation of the diameter thereof.

Analogously, additionally or alternatively to the detection of the diameter there may also be carried out the detection of the possible variation of the resistance or impedance of the wire related to surrounding conditions present on the place of processing thereof (for example the variation of the temperature of the operating environment itself). This is obtained through the impedance measurement member (of the per se known type) to which there is connected a sample reference product picked up by the machine 100. Such sample shall be used as a reference for controlling and comparing the entire subsequent production.

Due to at least one of the two detections of physical characteristics (and thus, dimensional through the member 50 or electrical through the member 60) of the wire carried out downstream of the supply device 1 and the use of the data detected from such members by the unit 18 of said supply device, the latter may send the wire to the machine with a correct and constant tension with the aim of maintaining the corresponding value of the controlled characteristic at least approximately around a predefined value, possibly programmable, or comparable with the reference sample.

The device subject of the present invention is thus capable of closing a second adjustment loop using the information received by the members 50 and/or 60.

For example, should the member 50 detect a reduction of the diameter of the wire, the unit 18 receives the corresponding data and operates on the motors 16 and 17, according to known control algorithms P, PI, PD, PID or FOC (Field Oriented Control), accelerating or decelerating them, with the aim of modifying the tension value of the wire (reducing it) so that the member 50 may detect a corresponding modification of the diameter (increase) of the wire up to a preset value. Analogously, should the member 60 detect a variation of the electrical characteristic of the finished product, send a signal to the unit 18 which modifies, as mentioned, the tension of the wire so that such characteristic returns to the selected and possibly programmed value. The device 1 is capable of guaranteeing the closure of this second adjustment loop and supplying the wire without varying the physical characteristics of the same (length, section, resistance, . . . ). Such device, in order to guarantee the value of the desired characteristic adjusts the tension of the wire controlling the torque of the two motors 16 and 17 which move the pulleys 14 and 15 on which the wire is wound. Thus, the device is capable of guaranteeing a tension (controlled through the sensor 25) of the exiting wire greater or lower than that present when unwinding from the coil by controlling the speed of the two motors 16 and 17 thus being able to maintain the desired physical characteristic of the wire downstream of the device 1.

Obviously, the supply device 1 (and in particular the one subject of the figures described in the Italian patent application MI2011A001983) is also capable, through a control and adjustment loop thereof, of adjusting the tension of the wire F exiting from the supply device itself with the aim of maintaining it constant and equivalent to a possibly programmable value. This regardless of the mode of adjusting such tension carried out based on the data that reaches the unit 18 from the members 50 or 60.

There has been described an embodiment of the invention; however, other possible embodiments (for example like the one in which the unit 18 or the sensor 25 are not associated to the body 2 of the supply device or the one in which the members 50 and 60, same case applying to the unit 18, are integrated in the machine or the one in which the member 50 is placed downstream of the supply device 1, but directly fixed to the latter) are allowed without departing from the scope of protection of the following claims.

The invention claimed is:

1. A system for supplying a metal wire unwound from a corresponding coil to a machine, the system comprising:

a tension sensor, a control unit, a wire supply device for supplying the wire with a desired predefined tension detected by the tension sensor, the supply device having at least one rotary member driven by an actuator thereof on which the metal wire is wound, for a fraction of rotation or several rotations and adapted to supply the wire to the machine with the predefined tension under the action of the control unit, detector means, for detecting at least one physical characteristic of the wire, arranged downstream of the supply device and connected to said control unit and adapted to provide to the control unit the data regarding each detected physical characteristic, said control unit intervening on said rotary member with the aim of adjusting the tension of the wire should said data differ from a preset and/or programmable reference value, said tension being adjusted to increase or decrease and subsequently maintained constant with the aim of maintaining, at least approximately around said reference value, the characteristic of the wire controlled, wherein the controlled physical characteristic is at least one dimensional characteristic of the wire and/or electrical characteristic of the wire.

2. The system according to claim 1, wherein the detector means is at least one member selected from the group consisting of a member for measuring a dimensional characteristic of the wire and a member for measuring the electrical resistance/impedance of the wire, wherein the member for measuring the dimensional characteristic of the wire is selected from the group consisting of an optical electronic gauge, a laser gauge, and an electronic clearing device.

3. The system according to claim 2, wherein the member for measuring the dimensional characteristic of the wire is arranged between the supply device and the machine.

4. The system according to claim 2, wherein the member for measuring the electrical resistance/impedance of the wire is arranged at the machine.

5. The system according to claim 4, wherein the member for measuring the electrical resistance of the wire is adapted to measure this physical characteristic of the wire when the wire is associated to a finished product.

6. The system according to claim 1, wherein the control unit is adapted to adjust the torque generated by the actuator on the rotary member as a function of the physical characteristic detected by said detector means, said tension possibly being greater or lower than that of unwinding the wire from the corresponding coil.

7. The system according to claim 6, wherein the control unit includes a microprocessor.

8. The system according to claim 1, wherein the control unit and said detector means are associated to the machine.

9. The system according to claim 1, wherein the detector means is associated to the machine.

10. The system according to claim 1, wherein the detector means is directly fixed to the supply device.

11. The system according to claim 1, wherein said control unit and said tension sensor are associated to the supply device.

12. The system according to claim 1, wherein the supply device is alternatively of the electromechanical or electronic type.

13. The system according to claim 1, wherein the controlled physical characteristic is selected from the diameter of the wire and/or an electrical characteristic of the wire.

14. The system according to claim 1, wherein the machine is a winding machine.

15. A method for supplying a metal wire unwound from a coil thereof to a machine, said supply occurring through the system according to claim 1, said method comprising the steps of:

picking up the wire from the coil, supplying the wire to a device for supplying the wire adapted to send the wire to the machine with a desired predetermined tension detected by a tension sensor, the tension sensor connected to a control unit which controls and commands said supply of the wire, detecting, downstream of the supply device, at least one physical characteristic of the wire by means of detector means connected to said control unit and adapted to provide to the control unit the data regarding each detected physical characteristic, said control unit commanding and controlling the supply of the wire through the actuator adjusting the supply tension when said data differs from a preset and/or programmable reference value, the adjustment of the tension alternatively providing a reduction or increase of the tension of the wire exiting from the supply device and a subsequent maintenance thereof in constant conditions with the aim of maintaining, at least around said reference value the characteristic of the wire controlled, wherein the controlled physical characteristic of the wire is at least one from among a dimensional characteristic of the wire, and an electrical characteristic of the wire.

16. The method according to claim 15, wherein the reference value is a value of a characteristic of a sample product used as reference and picked up by the machine, such product being connected to a member for measuring the electrical characteristic of the wire, said member comparing the current detected value of the wire associated with the finished product with that of the sample product.

17. The method according to claim 15, wherein the detection of the physical characteristic is alternatively carried out by intervening on the wire associated with the product obtained from the machine or on the wire directed to the machine.

18. The method according to claim 15, wherein the control unit intervenes on a rotary member driven by an actuator thereof, associated to the supply device, with the aim of adjusting the tension of the wire exiting from said supply device and directed to the machine, said tension, adjusted and maintained subsequently constant, being controlled by a tension sensor.

19. The method according to claim 15, wherein the dimensional characteristic is the diameter of the wire, and the electrical characteristic is the ohms resistance of the wire.

* * * * *